US006661400B2

(12) United States Patent
Sakashita

(10) Patent No.: US 6,661,400 B2
(45) **Date of Patent: *Dec. 9, 2003**

(54) LIQUID CRYSTAL PANEL DRIVE AND METHOD OF DRIVING LIQUID CRYSTAL PANEL

(75) Inventor: Yukihiko Sakashita, Kawasaki (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/177,571

(22) Filed: Oct. 23, 1998

(65) Prior Publication Data

US 2002/0015014 A1 Feb. 7, 2002

(30) Foreign Application Priority Data

Oct. 24, 1997 (JP) ..... 9-292472

(51) Int. Cl.[7] ..... G09G 3/36; G09G 5/10
(52) U.S. Cl. ..... 345/89; 345/690
(58) Field of Search ..... 345/87, 89, 147, 345/99, 90, 98, 690

(56) References Cited

U.S. PATENT DOCUMENTS

| | | | | |
|---|---|---|---|---|
| 4,864,290 A | * | 9/1989 | Waters | 345/87 |
| 5,119,084 A | | 6/1992 | Kawamura et al. | 340/784 |
| 5,434,589 A | * | 7/1995 | Nakamura et al. | 345/98 |
| 5,483,255 A | * | 1/1996 | Numao | 345/98 |
| 5,528,257 A | * | 6/1996 | Okumura et al. | 345/99 |
| 5,534,884 A | * | 7/1996 | Mase et al. | 345/87 |
| 5,841,416 A | * | 11/1998 | Mano et al. | 345/94 |

FOREIGN PATENT DOCUMENTS

| | | |
|---|---|---|
| JP | 3-90993 | 4/1991 |
| JP | 7-20828 | 1/1995 |

OTHER PUBLICATIONS

Patent Abstracts of Japan, vol. 098, No. 006, Apr. 30, 1998 & JP 10 039837 A (Hitachi Ltd), Feb. 13, 1998 abstract.
Patent Abstracts of Japan, vol. 015, No. 015, Jul. 17, 1991 & JP 03 096993 A Victor Co of Japan Ltd), Apr. 22, 1991 abstract.
H. Okumura et al., "A New Low–Image–Lag Drive Method for Large–Size LCTVs", Toshiba R&D Center, Kawasaki, Japan, SID 92 Digest, May 17, 1992.

* cited by examiner

*Primary Examiner*—Regina Liang
*Assistant Examiner*—Duc Q Dinh
(74) *Attorney, Agent, or Firm*—Fitzpatrick, Cella, Harper & Scinto

(57) ABSTRACT

A liquid crystal panel drive and a method of driving a liquid crystal panel are adapted to improve the hysteresis of the liquid crystal panel. The liquid crystal panel drive for driving a liquid crystal panel according to an input image signal comprises a coefficient generation means for generating a coefficient according to the level of the input image signal, a revision means for revising the reference peak level on the basis of the current level of the input image signal and the current reference peak level, a means for generating a corrected value on the basis of the peak level and the current level of the input image signal, a multiplication means for multiplying the corrected value by the coefficient and an addition means for adding the output of the multiplication means to the current input image signal to produce a drive signal for the liquid crystal panel.

4 Claims, 7 Drawing Sheets

FIG. 9

```
if (nrb< "110" ) then
   if rb (i, j, k−1)= "111" then
         rb(i, j, k)<=nrb ;
         tbw(i, j, k)<=0 ;
         tbp(i, j, k)<=0 ;
  else
         if top=0 then
              if(nrb<rb(i, j, k−1)) then
                   rb(i, j, k)<=nrb ;
         else
              rb(i, j, k)<=rb(i, j, k−1) ;
         end if ;
         tbw(i, j, k)<=tbw(i, j, k−1)+1 ;
         tbp(i, j, k)<=tbp(i, j, k−1) ;
      else
         rb(i, j, k)<=nrb ;
         tbw(i, j, k)<=0 ;
         tbp(i, j, k)<=0 ;

elsif (nrb= "110" ) then
     rb(i, j, k)<=rb(i, j, k−1) ;
     tbw(i, j, k)<=tbw(i, j, k−1) ;
     tbp(i, j, k)<=tbp(i, j, k−1)+1 ;

else
     if (rb(i, j, k−1)= "111" ) then
          rb(i, j, k)<=nrb :
          tbw(i, j, k)<=tbw(i, j, k−1)+1 :
          tbp(i, j, k)<=tbp(i, j, k−1) ;
     else
          rb(i, j, k)<=nrb :
          tbw(i, j, k)<=0 ;
          tbp(i, j, k)<=0 ;
end if ;
```

LIQUID CRYSTAL PANEL DRIVE AND METHOD OF DRIVING LIQUID CRYSTAL PANEL

BACKGROUND OF THE INVENTION

1. Field of the Invention

This invention generally relates to a liquid crystal panel drive and a method of driving a liquid crystal panel. More particularly, it relates to a liquid crystal panel drive and a method of driving a liquid crystal panel designed to improve the hysteresis of the liquid crystal panel.

2. Related Background Art

Known attempts for improving the image displaying performance of a liquid crystal panel include devices for improving the response speed of the panel as disclosed in Japanese Patent Application Laid-Open No. 3-90993 and U.S. Pat. No. 5,119,084.

These known devices are designed to improve the response speed and consequently the performance of displaying moving images of the liquid crystal panel and hence not adapted to improve the hysteresis of the panel. Therefore, there still remains the problem that the gradation of still and moving images displayed on the screen can become degraded by the hysteresis of the liquid crystal panel. Thus, there is a demand for novel methods for improving the hysteresis of a liquid crystal panel.

Like the present invention, Japanese Patent Application Laid-Open No. 7-20828 discloses an attempt for improving the hysteresis of a liquid crystal panel. The patent document proposes to prepare a table on the hysteresis of a liquid crystal panel and store it in a memory so that the performance of the liquid crystal of the panel may be corrected by referring to the table whenever necessary during the operation of the liquid crystal panel.

Japanese Patent Application Laid-Open No. 3-96993 proposes a technique for compensating the performance of the liquid crystal of a liquid crystal panel by utilizing the difference between two image signals separated by a field.

However, the techniques disclosed in the above patent documents are accompanied by the problem of structural complexity, although neither of them can achieve a satisfactorily high operating speed.

SUMMARY OF THE INVENTION

In view of the above identified existing technological problems, it is therefore the object of the present invention to provide a liquid crystal panel drive and a method of driving a liquid crystal panel designed to improve the hysteresis of the liquid crystal panel that are free from the above problems.

According to an aspect of the invention, the above object is achieved by providing a liquid crystal panel drive for driving a liquid crystal panel according to an input image signal, characterized by comprising:

a revision means for revising the reference peak level on the basis of the current level of the image signal and the current reference peak level; and a drive signal generation means for generating a drive signal for the liquid crystal panel on the basis of the level of the signal related to the reference peak level and the level of the current input image signal;

the liquid crystal panel being driven by the drive signal.

According to another aspect of the invention, there is provided a method of driving a liquid crystal panel according to an input image signal, characterized by comprising steps of:

driving the liquid crystal panel by a drive voltage determined on the basis of the voltage brightness correction characteristic of the liquid crystal panel selected according to a signal relating to the reference peak voltage currently retained by the input image signal and the current voltage of the input image signal; and sequentially revising the reference peak voltage on the basis of the current voltage of the input image signal and the currently retained peak voltage.

BRIEF DESCRIPTION OF THE DRAWINGS

FIG. 9 shows a program that can be used to produce Table 1.

DETAILED DESCRIPTION OF THE PREFERRED EMBODIMENTS

Now, the present invention will be described by referring to the accompanying drawings that illustrate preferred embodiments of the invention.

Figure 3A:
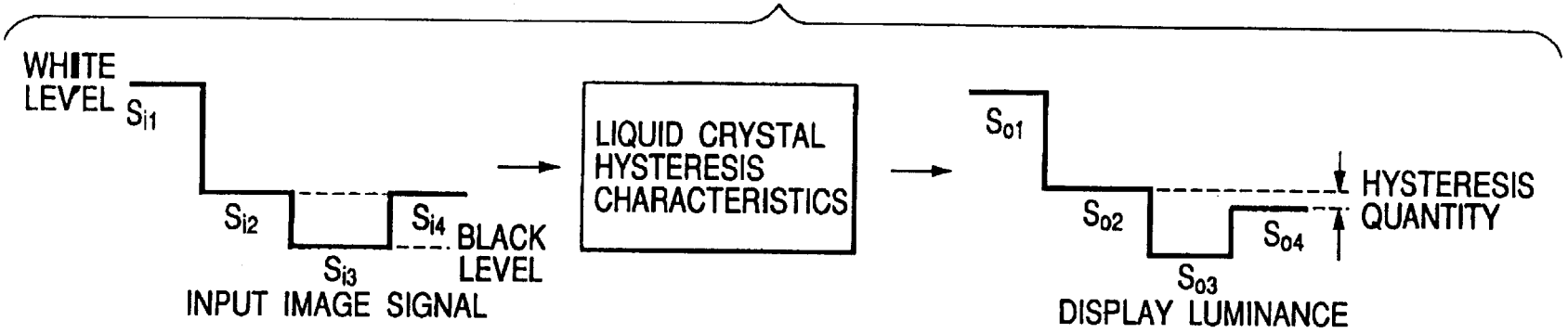
FIGS. 3A and 3B are illustrations of the principle of hysteresis correction of a liquid crystal panel that can be used for the purpose of the invention.
Figure 3B:
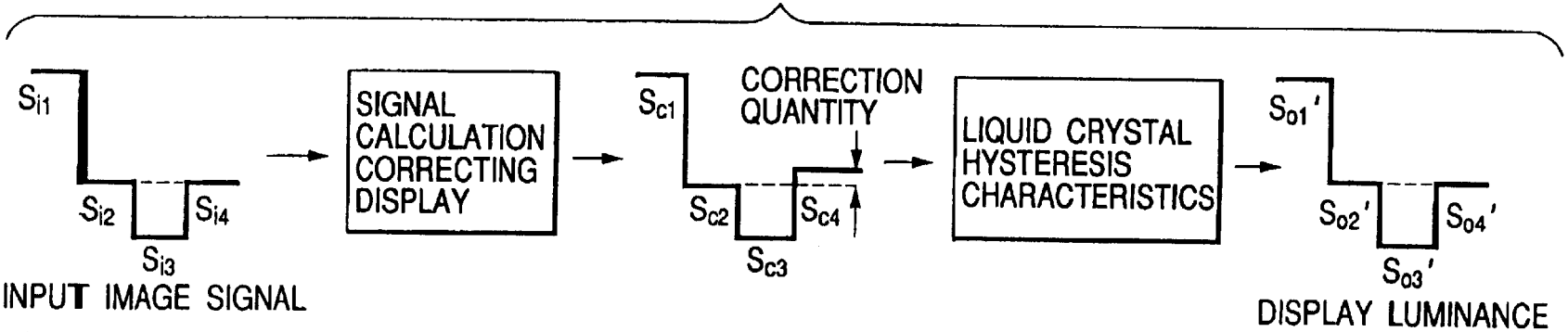

FIGS. 3A and 3B are illustrations of the principle of hysteresis correction of a liquid crystal panel that can be used for the purpose of the invention. Referring to FIG. 3A, input image signals $S_{i1}$ to $S_{i4}$ are signals for a same pixel input for every other frame. Signal $S_{i1}$ represents the white level and signal $S_{i2}$ represents the gray level, whereas signal $S_{i3}$ represents the black level and signal $S_{i4}$ represents also the gray level. Thus, both signals $S_{i2}$ and $S_{i4}$ represent a same level. $S_{o1}$ to $S_{o4}$ represent the levels of display brightness corresponding to the input image signals $S_{i1}$ to $S_{i4}$ respectively. As shown, the level of display brightness $S_{o4}$ is lower than that of display brightness $S_{o2}$ and hence a hysteretic quantity is generated between them. This is due to the hysteretic characteristics of the liquid crystal of the liquid crystal panel.

In this embodiment, the input signals are transformed into corrected signals by means of arithmetic operations for correcting display signals and the liquid crystal panel is driven by the corrected signals to eliminate any hysteretic quantity that can be generated in the liquid crystal panel as shown in FIG. 3B. Referring to FIG. 3B, the level of the display brightness $S_{o4}'$ is made to agree with that of the display brightness $S_{o2}'$ by transforming the input image signal $S_{i4}$ into corrected signal $S_{c4}$.

Before describing the embodiments in detail, some of the properties of liquid crystal panels found by the inventors of the present invention will be discussed.

Figure 4:
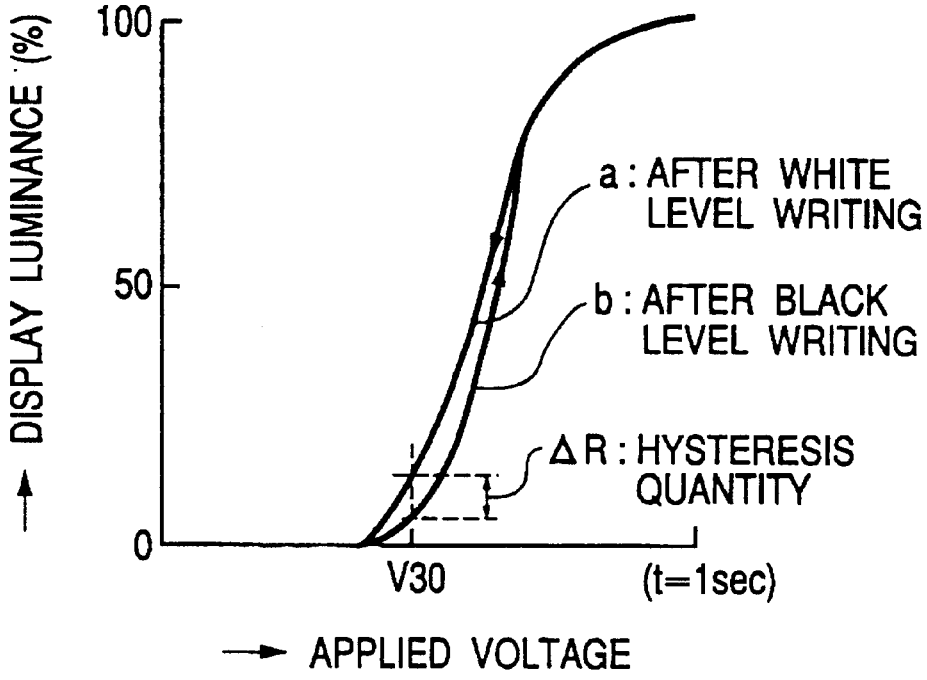
FIG. 4 is a graph showing a hysteretic characteristic (dependency on the applied voltage) of a liquid crystal panel.

FIG. 4 is a graph showing a hysteretic characteristic (of the dependency on the applied voltage) of the display brightness of a liquid crystal panel obtained when a varying voltage that shifts from the black level to the white level is applied to the panel. In FIG. 4, the curve a is the hysteretic characteristic (of the dependency on the applied voltage) of the display brightness after applying a voltage of the white level and the curve b is the corresponding hysteretic characteristic (of the dependency on the applied voltage) of the display brightness after applying a voltage of the black level. ΔR in FIG. 4 represents the hysteretic quantity generated between the display brightness obtained when a voltage corresponding to gradation 30 image signal is applied after applying a voltage of the white level and the display brightness obtained when a same voltage corresponding to gradation 30 image signal is applied after the application of a voltage of the black level.

Figure 7:
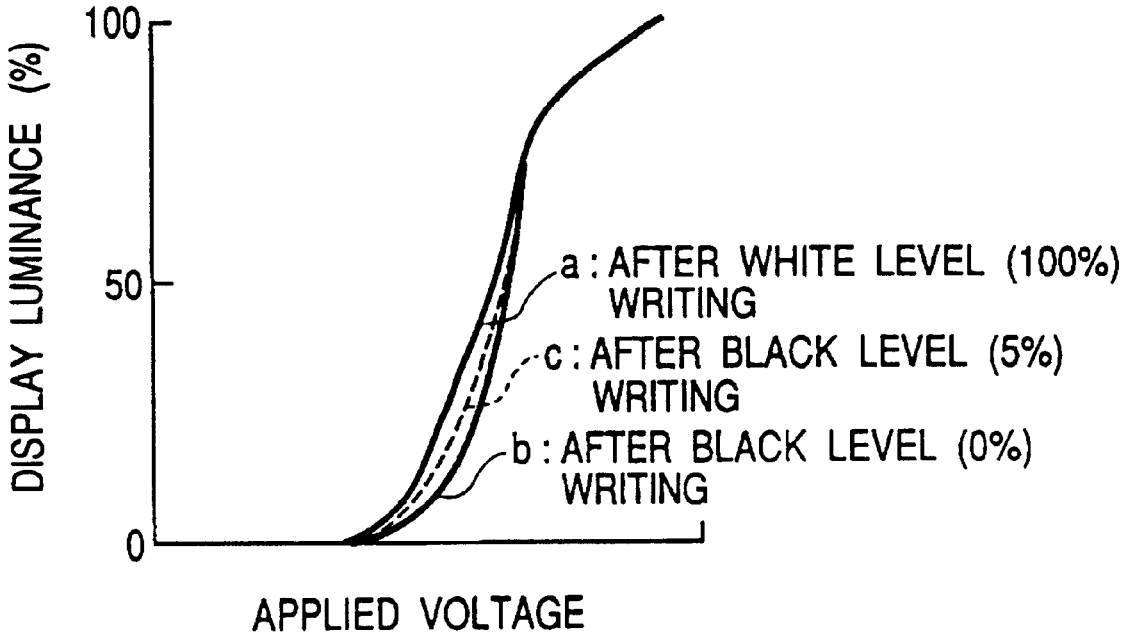
FIG. 7 is another graph showing the dependency of the performance of a liquid crystal panel on the applied voltage.
Figure 8:
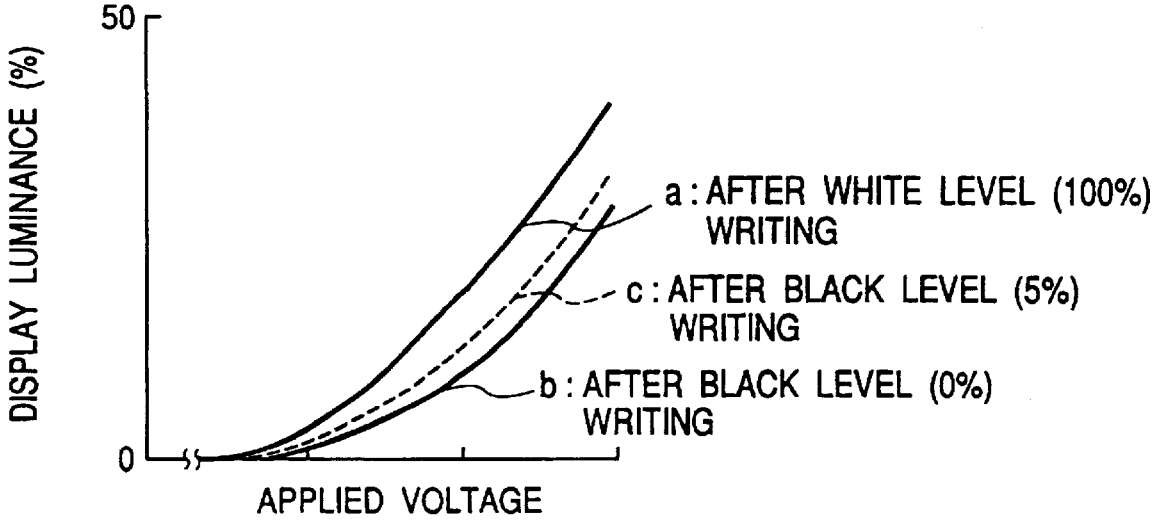
FIG. 8 is still another graph showing the dependency of the performance of a liquid crystal panel on the applied voltage.

This hysteretic characteristic also depends on the peak level (white level or black level) used as starting point. FIG. 7 shows the dependency of the performance of a liquid crystal panel on the peak level. More specifically, FIG. 7 shows the relationship between the applied voltage and the display brightness for three instances observed respectively after applying a voltage of the white level with a 100% brightness, after applying a voltage of the black level with a 0% brightness and after applying a voltage of the black level with a 5% brightness. Note that FIG. 4 shows the relationship between the applied voltage and the display brightness for two instances observed respectively after applying a voltage of the white level and after applying a voltage of the black level with a 0% brightness. As clearly seen from FIG. 7, the characteristic curve for a peak level corresponding to the black level with a 0% brightness differs from the curve for a peak level corresponding to the black level with a 5% brightness, although the peak levels are considerably close to each other. FIG. 8 is a graph showing the initial stages of the curves of FIG. 7 with an enlarged scale. This characteristic will be referred to as peak level dependency.

It will also be seen that, while the above hysteretic characteristic depend on the peak level, the characteristic curves appear similar to each other. For example, the difference between the characteristic curve for a peak level corresponding to the black level with a 0% brightness and the characteristic curve for a peak level corresponding to the white level with a 100% brightness for each applied voltage, which is a hysteretic quantity, converges to 0 as the black level and the white level approach each other near the gray level. This is also true for the characteristic curve for a peak level corresponding to the black level with a 5% brightness. Therefore, the hysteretic quantity can be determined by mapping a value (coefficient) representing the characteristic property on the level of the current image signal and multiplying a quantity representing the absolute value of the hysteretic quantity corresponding to the peak level by the coefficient. Then, the hysteresis of the display brightness can be corrected by applying the voltage that has been corrected for the obtained hysteretic quantity.

Each of the curves for the hysteretic characteristic of FIGS. 4 and 7 shows the display brightness when image signals for different levels of gradation are written 1 second after writing the white or black level. The hysteretic characteristic changes if the 1 second is replaced by some other time span. In short, the hysteresis depends on time.

Figure 5:
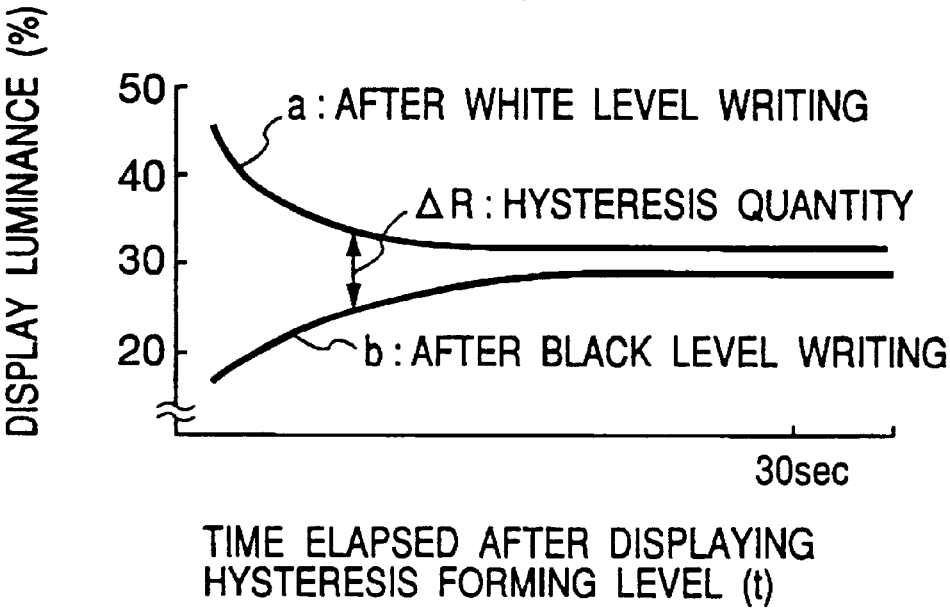
FIG. 5 is a graph showing another hysteretic characteristic (dependency on the elapse of time) of a liquid crystal panel.

FIG. 5 shows the hysteretic characteristic of time dependency. More specifically, FIG. 5 shows the transitional stages of the display brightness when a signal for gradation 30 is applied stepwise after applying the black level and that of the display brightness when a signal for gradation 30 is applied stepwise after applying the white level. As clear from FIG. 5, while the responsiveness of the display brightness reflects the LPF characteristics and depends on the liquid crystal panel, the curves for the two occasions converge to a same level typically after 30 seconds.

Figure 6:
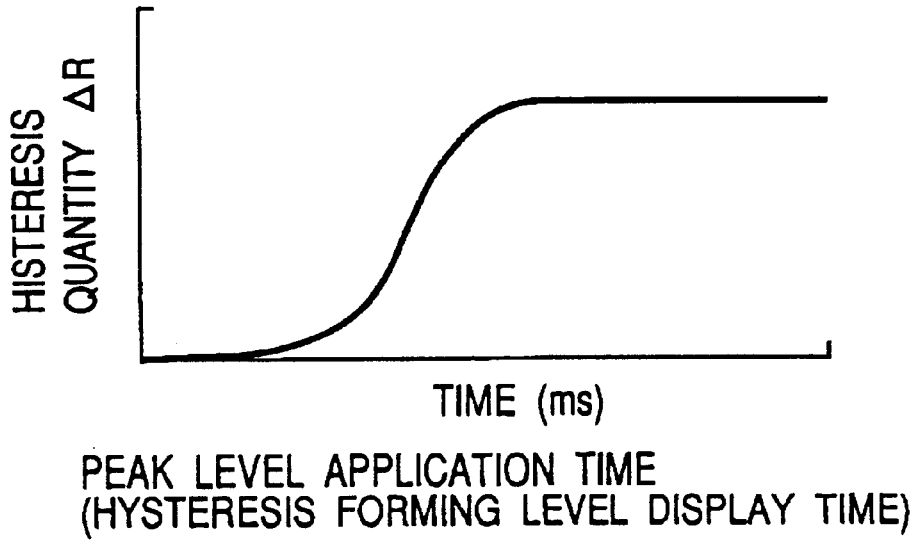
FIG. 6 is a graph showing still another hysteretic characteristic (the dependency of the hysteresis generation level on the display time) of a liquid crystal panel.

The time dependency of hysteresis has another aspect. The hysteretic quantity also depends on the time during which the voltage of the peak level (hysteresis generation level) is applied. FIG. 6 shows that the hysteretic quantity ΔR varies depending on the time during which the voltage of the peak level is applied.

In this embodiment, the hysteresis is corrected by utilizing the above described peak level dependency and two different time dependencies. Additionally, the similarity of the hysteretic behaviors of liquid crystal panels is also utilized. More specifically, in this embodiment, image signals whose peak level is the black level and those whose peak level is the white level are corrected.

Figure 1:
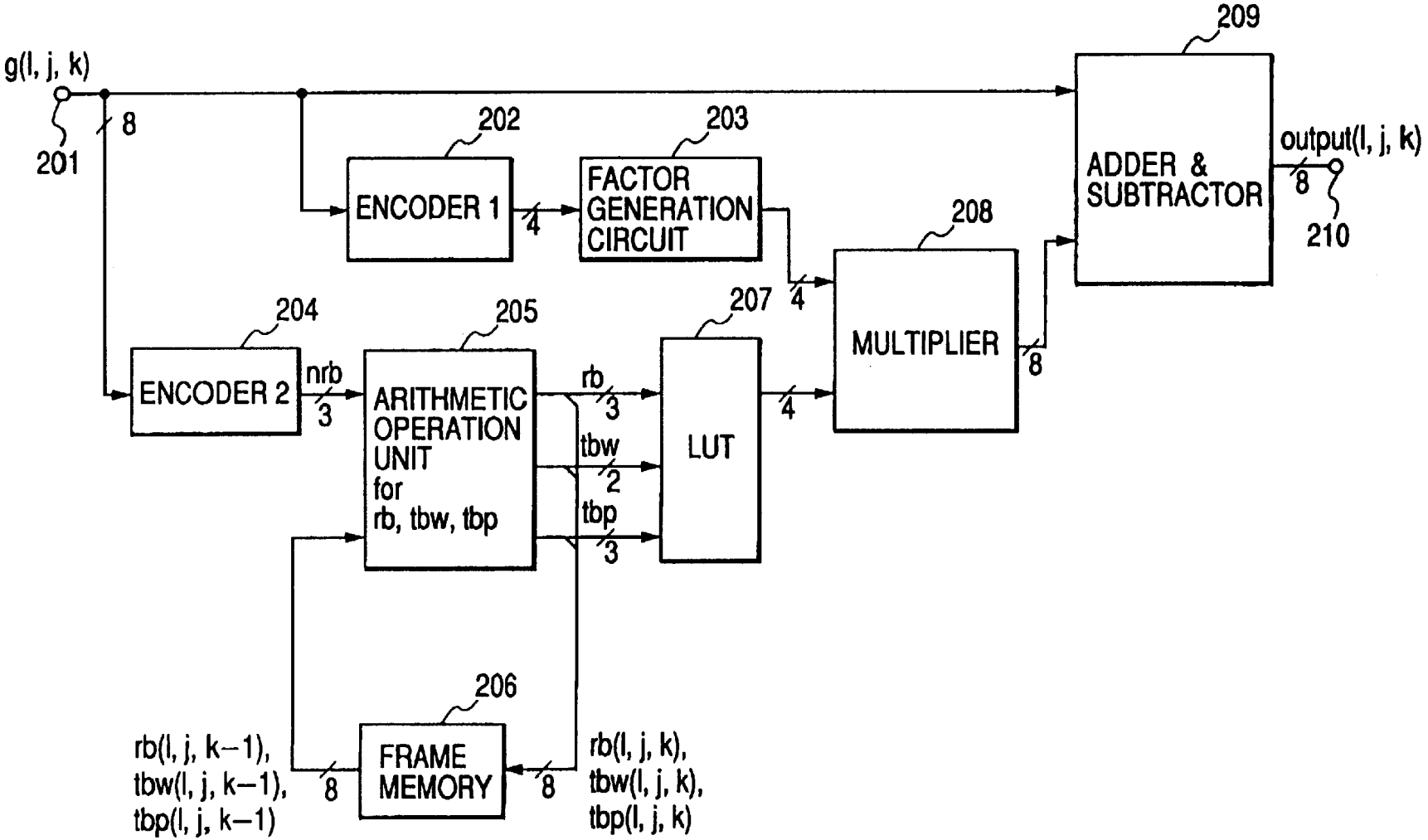
FIG. 1 is a schematic block diagram of an embodiment of liquid crystal panel drive according to the invention.

FIG. 1 is a schematic block diagram of the embodiment of liquid crystal panel drive according to the invention.

Referring to FIG. 1, reference numeral 201 denotes an image signal input terminal for receiving image signal g(l, j, k), where l represents the position of the image signal in terms of the horizontal direction of the screen and j represents the position of the signal in terms of the vertical direction of the screen, whereas k represents the frame number. Reference numeral 202 denotes encoder 1 for dividing the level of the image signal g(l, j, k) into 16 sections and encoding it into a 4-bit code. Reference numeral 203 denotes a coefficient generation circuit for generating a coefficient on the basis of the output of the encoder 1 (reference numeral 202) and reference numeral 204 denotes encoder 2 for dividing the level of the image signal g(l, j, k) into 8 sections and encoding it into a 3-bit code before outputting the encoded value nrb. Reference numeral 205 denotes an arithmetic unit which may typically be a CPU. Reference numeral 206 denotes a frame memory for delaying the output of the arithmetic unit 205 by a frame. The arithmetic unit 205 receives the output nrb of the encoder 2 (reference numeral 204) and the outputs rb(l, j, k−1), tbw(l, j, k−1) and tbp(l, j, k−1) of the frame memory 206 and outputs the outcome of arithmetic operations, or rb(l, j, k), tbw(l, j, k) and tbp(l, j, k). Signal rb(l, j, k) represents the retained peak level. As described above, the peak level is directed to the black level in this embodiment. The signal tbw(l, j, k) represents the duration of time (number of frames) of an image signal with the peak level. The signal tbp(l, j, k) represents the duration of time (number of frames) of an image signal with a level higher than the peak level. Reference numeral 207 denotes a look-up table (hereinafter referred to as LUT) that receives outputs rb(l, j, k), tbw(l, j, k), tbp(l, j, k) of the arithmetic unit 205 and by turn outputs, for example, a corrected 4-bit quantity. Reference numeral 208 denotes a multiplier for multiplying the corrected quantity output from the LUT 207 by the coefficient output from the coefficient generation circuit 203. Reference numeral 209 denotes an adder/subtracter for adding the product of multiplication of the corrected quantity from the multiplier 208 and the coefficient to the image signal g(l, J, k) and outputting the sum as liquid crystal panel drive signal output(l, j, k).

Figure 2:
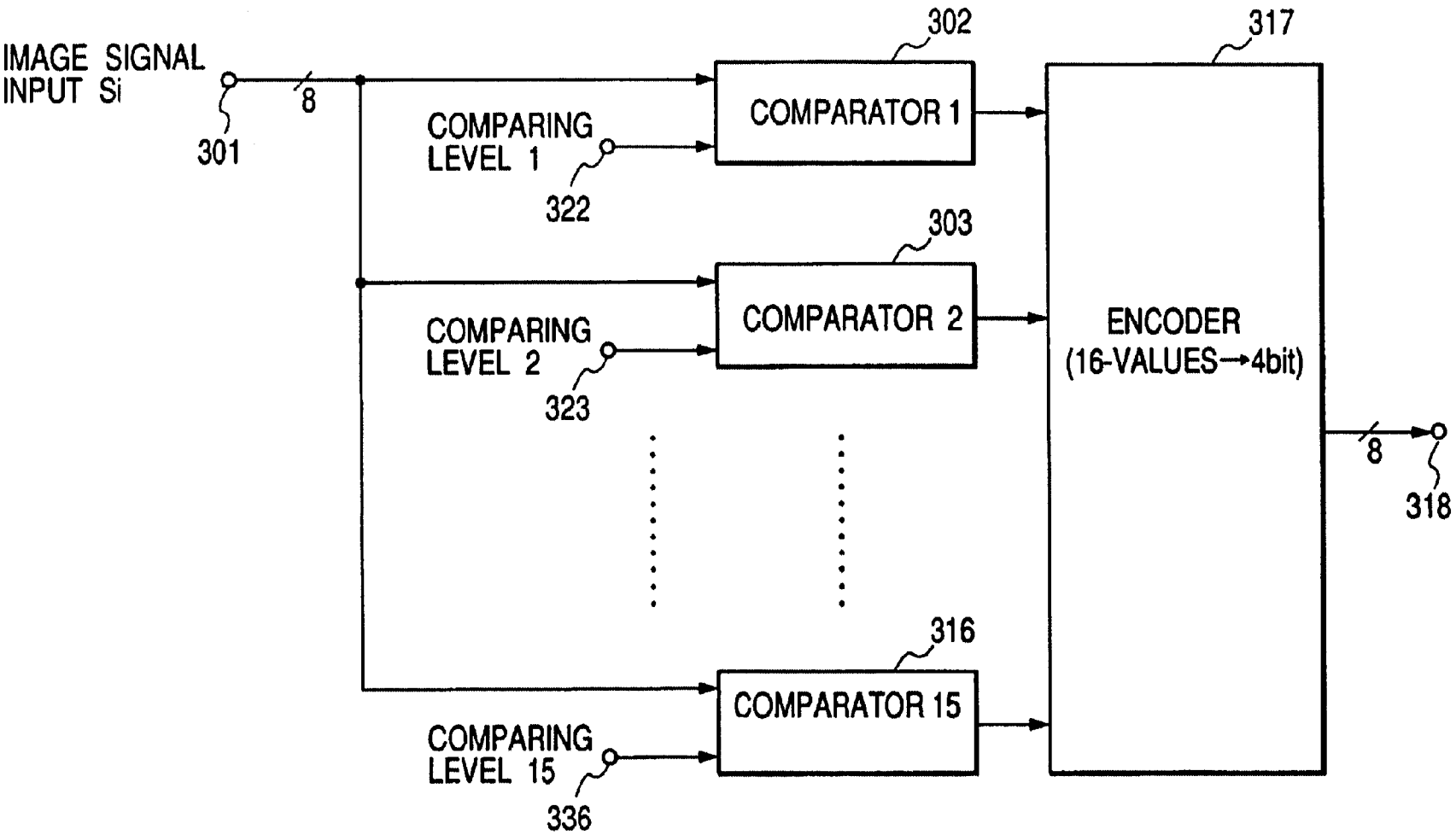
FIG. 2 is a schematic block diagram of the encoder that can be used for the embodiment of FIG. 1.

FIG. 2 a schematic block diagram of the encoder 1 (reference numeral 202). The encoder 1 (reference numeral 202) comprises a total of fifteen comparators 1 to 15 (reference numerals 302 to 316) for comparing the input image signal with respective comparison levels 1 to 15 (reference numerals 322 to 336) and an encoder 317 for coding the 15-bit output of the comparators 1 to 15 (reference numerals 302 to 316) into a 4-bit code. The output can be non-linearly coded by selecting appropriate comparison levels. Thus, finely differentiated comparison levels can be selected for a region where the hysteresis varies remarkably to minimize the coefficient error, while using a relatively small number of bits for encoding.

The encoder 2 (reference numeral 204) has a configuration similar to the encoder 1 (reference numeral 202). Output nrb of the encoder 2 (reference numeral 204) takes a value found within a range between "000b" and "111b". The range between "000b" and "101b" of the output nrb refers to six steps of the black level, where step "000b" is remotest from the white level and step "101b" is closest to the white level. In this embodiment, the range between "000b" and "101b" is referred to as black side hysteresis generation level. Step "111b" is referred to as white side hysteresis generation level. Step "110b" is referred to as intermediary level, where the display characteristic (the relationship between the applied voltage and the brightness) of the liquid crystal panel does not change. Thus, when the black side hysteresis generation level ("000b" to "101b") is displayed before displaying the intermediary level, the display characteristic is lopsided to the black side hysteresis, whereas, when the white side hysteresis generation level ("111b") is displayed before displaying the intermediary level, the display characteristic is lopsided to the white side hysteresis. To repeat the above description, tbw represents the time during which the black level ("000b" to "101b") or the white level ("111b") is displayed and tbp represents the time elapse of time since the transition to the intermediary level ("110b") after displaying the black level ("000b" to "101b") or the white level ("111b").

The level of 60% of the image signal may typically be selected for the boundary line separating value "110b" and the value "111b" for output nrb. On the other hand, the level of 10% of the image signal may typically be selected for the boundary line separating value "101b" and value "110b".

The arithmetic unit 205 performs arithmetic operations for determining the display characteristic (the relationship between the applied voltage and the brightness) retained by a displaying pixel for the hysteresis due to the white level or the black level. In other words, it determines the elapse of time tbp since the time when a hysteresis generating region was displayed on the basis of the level rb of the hysteresis generating region and the duration of time tbw of displaying the hysteresis generating region and then the LUT 208 determines the corrected quantity for the hysteresis on the basis of the determined elapse of time.

Now, the operation of the arithmetic unit 205 will be described by referring to Table 1 below showing the correspondence between the input and the output of the arithmetic unit 205.

TABLE 1

| input | | | output | | |
|---|---|---|---|---|---|
| current pixel nrb | preceding pixel rb (l,j,k-1) | tbp (l,j,k-1) | rb (l,j,k) | tbw (l,j,k) | tbp (l,j,k) |
| <"110" | ≠"111" | =0 | smaller | +1 | previous value (1) |
| | | ≠0 | current pixel nrb | reset | reset (2) |
| | ="111" | don't care | current pixel nrb | reset | reset (3) |

TABLE 1-continued

| input | | | output | | |
|---|---|---|---|---|---|
| current pixel nrb | preceding pixel rb (l,j,k-1) | tbp (l,j,k-1) | rb (l,j,k) | tbw (l,j,k) | tbp (l,j,k) |
| ="110" | don't care | don't care | current pixel rb | previous value | +1 (4) |
| ="111" | ="111" | don't care | current pixel nrb | +1 | previous value (5) |
| | ≠"111" | don't care | current pixel rb | reset | reset (6) |

Firstly, the arithmetic unit 205 determines the history of the currently displaying pixel in terms of the display characteristics due to its hysteresis on the basis of nrb, rb and tbp. Then, it calculates the values of rb, tbw and tbp to be output to the LUT 208 and the frame memory 206 on the basis of the outcome of its determining operation.

The arithmetic operations of the arithmetic unit 205 can be classified into six categories (1) to (6) of Table 1, which will be described below.

(1) When the signal level nrb of the image signal for the current frame is "000b" to "101b", it represents the black side hysteresis region so that the arithmetic unit 205 compares the signal level with the value rb (=rb(l,j,k−1)) for the previous frame. If nrb is not greater than "101b", it indicates the hysteresis generated on the black side. Then, the arithmetic unit 205 determines if the black level is continuing from the previous pixel or if the previous pixel is at the intermediary level on the basis of tbp. If tbp=0, it indicates that the previous frame was on the black level so that the retained black level is revised. The revised black level will be the black level rb because the smaller of nrb and rb is rb and hence rb is written in the frame memory 206 so that a greater hysteretic quantity may be retained. Again, if tbp=0, 1 is added to tbw because the display of the black level continues. On the other hand, tbp retains the current value.

(2) When tbp≠0, the pixel was at the intermediary level at the previous frame. Then, rb=nrb is realized and both tbw and tbp are reset to 0 in order to revise the hysteresis generation level.

(3) When the previous hysteresis generation level was rb="111b", it indicates the pixel was on the white level at the previous frame. Then, rb=nrb is realized and both tbw and tbp are reset to 0 in order to revise the hysteresis generation level.

(4) When the current pixel signal level is nrb="110b", the display characteristics determined on the hysteretic history are retained so that both rb and tbw retain the respective current values and 1 is added to tbp that represents the elapse of time after passing to the hysteresis generating region.

(5) When the current pixel signal level is at "111b" and the previous hysteresis generation level rb was equal to "111b", it indicates that the value used for the display at the previous frame was that of the white level. Then, 1 is added to tbw that represents the period of time for writing the hysteresis generation level.

(6) When the current pixel signal level is at "111b", it indicates that the value used for the display at the previous frame was not that of the white level. Then, rb=nrb is realized and both tbw and tbp are reset to 0 in order to revise the hysteresis generation level to the white level.

FIG. 9 shows a program that can be used to produce Table 1.

The duration of time tbw of displaying the hysteresis generation level and the duration of time tbp of displaying the intermediary gradation level can be revised not on a frame by frame basis but every several frames, the number of which can be arbitrarily selected, by using a reference signal coming from the counter for counting the number of frames or a technique of receiving a reference signal regularly and cyclically from a CPU. With such an arrangement, the relationship between the number of bits for the duration of time tbw of displaying the hysteresis generation level and the duration of time tbp of displaying the intermediary gradation level and the period of cyclic revision can be selected appropriately by taking the relationship between the level of accuracy required for arithmetic operations and the quantity of hardware into consideration.

The encoder 1 (reference numeral 202), the coefficient generation circuit 203, the LUT 207, the multiplier 208 and the adder 209 may be realized as a single LUT.

While the hysteretic quantity is determined from the duration of time of displaying the hysteresis generation level, the duration of time of displaying the intermediary gradation level and the current image signal level in this embodiment, this embodiment may be so modified as to omit one or more than one of the above listed factors if the performance of the liquid crystal panel is improved and such factor or factors may be disregarded.

[Advantages of the Invention]

As described above, the gradation of still and moving images displayed on the screen of a liquid crystal panel according to the invention can be improved if degraded by hysteresis. Thus, a liquid crystal panel according to the invention can maintain its operation of displaying high quality images regardless of hysteresis.

What is claimed is:

1. A liquid crystal panel drive for driving a plurality of pixels in a liquid crystal panel according to an input image signal, and for improving a hysteresis of said liquid crystal panel, said liquid crystal panel drive comprising:

a frame memory for storing a frame memory signal including:

(1) a reference peak level corresponding to a hysteresis generation level, (2) a duration of time of the reference peak level, and (3) a duration of time of an intermediary level;

revision means for revising said frame memory signal on the basis of a present level of the input image signal; and drive signal generation means for generating a drive signal for the liquid crystal panel on the basis of both the revised frame memory signal and the present level of the input image signal, wherein the liquid crystal panel is driven by the drive signal so as to be capable of producing, for each of the plurality of pixels, a multi-level display according to the drive signal.

2. A liquid crystal panel drive according to claim 1, wherein said drive signal generation means comprises:

a corrected value generation means for generating a corrected value on the basis of the revised memory signal;

a coefficient generation means for generating a coefficient according to the present level of the input image signal;

a multiplication means for multiplying the corrected value by the coefficient; and an addition means for adding the output of said multiplication means to the present level of the input image signal to produce the drive signal for said liquid crystal panel.

3. A method of driving a plurality of pixels in a liquid crystal panel according to an input image signal, said method improving a hysteresis of the liquid crystal panel and comprising the steps of:

storing a frame memory signal including:

(1) a reference peak level corresponding to a hysteresis generation level, (2) a duration of time that a peak level of the input image signal has equaled the stored reference peak level, and (3) a duration of time that an intermediary level of the input image signal, which is less than the stored reference peak level, has persisted;

sequentially revising said frame memory signal on the basis of a present level of the input image signal; and driving the liquid crystal panel by a drive signal determined on the basis of a voltage brightness correction characteristic of the liquid crystal panel selected according to both the revised frame memory signal, and the present level of the input image signal, wherein the liquid crystal panel is driven by the drive signal in said driving step so as to be capable of producing for each of the plurality of pixels, a multi-level display.

4. A method of driving a liquid crystal panel according to claim 3, wherein the drive signal is determined by adding: (1) a product of multiplication of a corrected value determined according to the voltage brightness correction characteristic and a coefficient determined according to the present level of the input image signal, and (2) the present level of the input image signal.

* * * * *

UNITED STATES PATENT AND TRADEMARK OFFICE

CERTIFICATE OF CORRECTION

PATENT NO. : 6,661,400 B2
DATED : December 9, 2003
INVENTOR(S) : Yukihiko Sakashita It is certified that error appears in the above-identified patent and that said Letters Patent is hereby corrected as shown below:

Drawings,
Sheet 1, Figure 1, "SUBTRACTOR" should read -- SUBTRACTER --.
Sheet 6, "HISTERESIS" should read -- HYSTERESIS --.

Column 3,
Line 40, "depend" should read -- depends --.

Column 4,
Line 9, "AR" should read -- ΔR --; and
Line 57, "signal g(1, J, k) should read -- signal g(1, j, k) --.

Signed and Sealed this

Thirteenth Day of July, 2004

JON W. DUDAS
*Acting Director of the United States Patent and Trademark Office*